US011817079B1

(12) United States Patent
Sima et al.

(10) Patent No.: US 11,817,079 B1
(45) Date of Patent: Nov. 14, 2023

(54) GAN-BASED SPEECH SYNTHESIS MODEL AND TRAINING METHOD

(71) Applicant: NANJING SILICON INTELLIGENCE TECHNOLOGY CO., LTD., Jiangsu (CN)

(72) Inventors: Huapeng Sima, Jiangsu (CN); Zhiqiang Mao, Jiangsu (CN)

(73) Assignee: NANJING SILICON INTELLIGENCE TECHNOLOGY CO., LTD., Jiangsu (CN)

( * ) Notice: Subject to any disclaimer, the term of this patent is extended or adjusted under 35 U.S.C. 154(b) by 0 days.

(21) Appl. No.: 18/210,907

(22) Filed: Jun. 16, 2023

(30) Foreign Application Priority Data

Jul. 20, 2022 (CN) ..... 202210849698.9

(51) Int. Cl.
*G10L 13/047* (2013.01)
*G10L 25/30* (2013.01)

(52) U.S. Cl.
CPC ..... *G10L 13/047* (2013.01); *G10L 25/30* (2013.01)

(58) Field of Classification Search
CPC ..... G10L 13/047; G10L 25/30
USPC ..... 704/258
See application file for complete search history.

(56) References Cited

U.S. PATENT DOCUMENTS

2021/0312243 A1* 10/2021 Wang ..... G06T 7/194
2022/0208355 A1* 6/2022 Li ..... G06T 7/0016
2022/0392428 A1* 12/2022 Fernandez Guajardo ..... G10L 13/047

FOREIGN PATENT DOCUMENTS

CN 111627418 A 9/2020
CN 112037760 A 12/2020
CN 112712812 A * 4/2021
CN 113066475 A 7/2021
(Continued)

OTHER PUBLICATIONS

K. Jeong, H.-K. Nguyen and H.-G. Kang, "A Fast and Lightweight Text-to-Speech Model with Spectrum and Waveform Alignment Algorithms," 2021 29th European Signal Processing Conference (EUSIPCO), Dublin, Ireland, 2021, pp. 41-45, doi: 10.23919/EUSIPCO54536.2021.9616247. (Year: 2021).*
(Continued)

*Primary Examiner* — Bharatkumar S Shah
(74) *Attorney, Agent, or Firm* — Bret E. Field; Bozicevic, Field & Francis LLP

(57) ABSTRACT

The present disclosure provides a GAN-based speech synthesis model, a training method, and a speech synthesis method. According to the speech synthesis method, to-be-converted text is obtained and is converted into a text phoneme, the text phoneme is further digitized to obtain text data, and the text data is converted into a text vector to be input into a speech synthesis model. In this way, target audio corresponding to the to-be-converted text is obtained. When a target Mel-frequency spectrum is generated by using a trained generator, accuracy of the generated target Mel-frequency spectrum can reach that of a standard Mel-frequency spectrum. Through constant adversary between the generator and a discriminator and the trainings thereof, acoustic losses of the target Mel-frequency spectrum are reduced, and acoustic losses of the target audio generated based on the target Mel-frequency spectrum are also reduced, thereby improving accuracy of audio synthesized from speech.

7 Claims, 2 Drawing Sheets

(56) References Cited

FOREIGN PATENT DOCUMENTS

| | | | |
|---|---|---|---|
| CN | 113409759 | A | 9/2021 |
| CN | 113436609 | A | 9/2021 |
| CN | 113539232 | A | 10/2021 |
| CN | 114038447 | A | 2/2022 |
| CN | 114169291 | A | 3/2022 |
| CN | 114512112 | A | 5/2022 |
| WO | WO2022126924 | A1 | 6/2022 |

OTHER PUBLICATIONS

W. Zhao, W. Wang, J. Chai and J. Huang, "IVCGAN:An Improved GAN for Voice Conversion," 2021 IEEE 5th Information Technology,Networking, Electronic and Automation Control Conference (ITNEC), Xi'an, China, 2021, pp. 1035-1039, doi: 10.1109/ITNEC52019.2021.9587053. (Year: 2021).*

* cited by examiner

GAN-BASED SPEECH SYNTHESIS MODEL AND TRAINING METHOD

CROSS-REFERENCE TO RELATED APPLICATIONS

This application claims priority to Chinese Patent Application No. 202210849698.9, entitled "GAN-BASED SPEECH SYNTHESIS MODEL AND SPEECH SYNTHESIS METHOD", filed with the China National Intellectual Property Administration (CNIPA) on Jul. 20, 2022, the entire disclosure of which is incorporated by reference in its entirety herein.

FIELD OF THE INVENTION

The present disclosure relates to the technical field of speech synthesis, and in particular, to a GAN-based (Generative Adversarial Network-based) speech synthesis model and a training method.

BACKGROUND OF THE INVENTION

With development of artificial intelligence, in some software products, such as map navigation software, audiobook software, or language translation software, text needs to be converted into speech. Demand of people for automatically converting text into speech is increasing.

At present, converting of text into speech mainly relies on a speech synthesis technology. An acoustic model and a vocoder are required for use of the speech synthesis technology. To enable the speech synthesized from the text to be similar with human voice, the acoustic model and the vocoder used in the speech synthesis technology need to be trained separately.

During the process of training the acoustic model and the vocoder respectively, the acoustic model may have some losses, resulting in a loss in voice quality of the synthesized speech. An existing acoustic model is trained based on a mean square error loss or an average absolute error loss, resulting in a great deviation in later use of the acoustic models. Due to the deviation, more losses are generated during the process of training the acoustic model. Moreover, if the loss of the acoustic model is too large, the vocoder may also be affected accordingly during the training process. As a result, the voice quality of the synthesized speech cannot have accuracy similar to that of the human voice. In related technologies, a problem that accuracy of the training of the acoustic model is not yet ideal due to the loss occurring during the training of the acoustic model cannot be resolved.

SUMMARY OF THE INVENTION

To resolve a problem that training accuracy of an acoustic model is not ideal due to losses occurring during the training of the acoustic model, according to a first aspect, an embodiment of the present disclosure provides a GAN-based speech synthesis model, including:

a generator configured to be obtained by being trained based on a first discrimination loss for indicating a discrimination loss of the generator and a second discrimination loss for indicating a mean square error between the generator and a preset discriminator; and a vocoder configured to synthesize target audio corresponding to to-be-converted text from a target Mel-frequency spectrum, wherein the generator includes:

a feature encoding layer, configured to obtain a text feature based on a text vector, the text vector being obtained by processing the to-be-converted text;

an attention mechanism layer, configured to calculate, based on a sequence order of the text feature, a relevance between the text feature at a current position and an audio feature within a preset range, and determine contribution values of each text feature relative to different audio features within the preset range, the audio feature being used for indicating an audio feature corresponding to a pronunciation object preset by the generator; and a feature decoding layer, configured to match the audio feature corresponding to the text feature based on the contribution value, and output the target Mel-frequency spectrum by the audio feature.

In an embodiment of the present disclosure, the generator adopts a self-cycle structure or a non-self-cycle structure.

In an embodiment of the present disclosure, for implementing a speech synthesis method, the model is configured to:

acquire to-be-converted text;

convert the to-be-converted text into a text phoneme based on spelling of the to-be-converted text;

digitize the text phoneme to obtain text data;

convert the text data into a text vector; and process the text vector into target audio corresponding to the to-be-converted text.

Further, for converting the to-be-converted text into the text phoneme based on the spelling of the to-be-converted text, the model is configured to:

perform prosody prediction on the to-be-converted text to obtain encoded text;

convert the encoded text into a spelling code including pinyin and a tone numeral of the encoded text; and convert the spelling code into the text phoneme based on pronunciation of the encoded text.

Furthermore, for digitizing the text phoneme to obtain the text data, the model is configured to:

digitize the text phoneme based on a character code, the character code including characters corresponding to a pinyin letter and a tone numeral in the text phoneme.

In an embodiment of the present disclosure, the model is further configured to: before converting the encoded text into the spelling code, insert a pause character, at a position of a pause punctuation mark, into the encoded text, the pause character being used for segmenting the to-be-converted text based on the pause punctuation mark of the to-be-converted text;

insert an end character, at a position of an end punctuation mark, into the encoded text, the end character being used for determining an end position of the to-be-converted text based on the end punctuation mark of the to-be-converted text; and convert the encoded text by segments based on the pause character and the end character for the converting of the encoded text into the spelling code.

According to a second aspect, an embodiment of the present disclosure provides a GAN-based speech synthesis method, including:

acquiring to-be-converted text;

converting the to-be-converted text into a text phoneme based on spelling of the to-be-converted text;

digitizing the text phoneme to obtain text data;

converting the text data into a text vector; and inputting the text vector into the speech synthesis model to obtain target audio corresponding to the to-be-converted text.

According to a third aspect, an embodiment of the present disclosure provides a training method for a GAN-based speech synthesis model, including:

S1. inputting sample text into a generator to obtain a first Mel-frequency spectrum;

S2. performing training for a first discrimination loss based on the first Mel-frequency spectrum and a second Mel-frequency spectrum, the second Mel-frequency spectrum being a Mel-frequency spectrum for indicating an audio label of a corresponding annotation of the sample text;

S3. inputting the first Mel-frequency spectrum into a discriminator to obtain a first discriminative feature, and performing training for a second discrimination loss based on the first discriminative feature;

S4. performing training for a third discrimination loss based on the first Mel-frequency spectrum, the second Mel-frequency spectrum, and a discrimination result for the first Mel-frequency spectrum and the second Mel-frequency spectrum, the third discrimination loss being used for indicating a discrimination loss of the discriminator, and the discrimination result being used for indicating a relevance between the first Mel-frequency spectrum and the second Mel-frequency spectrum; and performing S2 to S4 alternately until the first discrimination loss, the second discrimination loss, and the third discrimination loss converge, to obtain the trained generator.

In an embodiment of the present disclosure, the discriminator includes:

a training module, configured to perform training for the second discrimination loss based on the discriminative feature, and perform training for the third discrimination loss based on the first Mel-frequency spectrum, the second Mel-frequency spectrum, and the discrimination result; and a discrimination module, configured to obtain the discrimination result for the first Mel-frequency spectrum and the second Mel-frequency spectrum based on the relevance between the first Mel-frequency spectrum and the second Mel-frequency spectrum.

In an embodiment of the present disclosure, the method further includes:

when the relevance between the first Mel-frequency spectrum and the second Mel-frequency spectrum is greater than a preset value, stopping the training for the first discrimination loss, the second discrimination loss, and the third discrimination loss, to obtain the trained generator.

In an embodiment of the present disclosure, a step of obtaining the third discrimination loss includes:

inputting the second Mel-frequency spectrum into the discriminator to obtain a second discriminative feature; and calculating a first mean square error between the first discriminative feature and 1 and a second mean square error between the second discriminative feature and 0, to obtain a first mean square error result and a second mean square error result.

It can be learned from the foregoing solutions that the present disclosure provides a GAN-based speech synthesis model, a training method, and a speech synthesis method. According to the speech synthesis method, the to-be-converted text is obtained and is converted into the text phoneme, the text phoneme is further digitized to obtain the text data, and the text data is converted into the text vector to be input into the speech synthesis model. In this way, the target audio corresponding to the to-be-converted text is obtained. According to the training method for a speech synthesis model, the sample text is input into the generator, the generator generates the first Mel-frequency spectrum, and the first Mel-frequency spectrum and the second Mel-frequency spectrum are input into the discriminator. During the discrimination process, the trainings for the first discrimination loss, the second discrimination loss, and the third discrimination loss of the generator and the discriminator are constantly performed to converge, to obtain the trained generator. When the target Mel-frequency spectrum is generated by using the trained generator, accuracy of the generated target Mel-frequency spectrum can reach that of a standard Mel-frequency spectrum. Through constant adversary between the generator and a discriminator and trainings thereof, acoustic losses of the target Mel-frequency spectrum are reduced, and acoustic losses of the target audio generated based on the target Mel-frequency spectrum are also reduced, thereby improving accuracy of audio synthesized from speech.

BRIEF DESCRIPTION OF THE DRAWINGS

To more clearly describe the technical solutions of the present disclosure, the accompanying drawings to be used in the embodiments are briefly described below. Obviously, persons of ordinary skills in the art can further derive other accompanying drawings according to these accompanying drawings without an effective effort.

DETAILED DESCRIPTION OF THE EMBODIMENTS

The present disclosure is described below in detail with reference to the accompanying drawings and in conjunction with the embodiments. It should be noted that the embodiments in the present disclosure and the features in the embodiments can be combined with each other without conflict.

It should be noted that the terms such as "first", "second", and the like in this specification, the claims, and the accompanying drawings of the present disclosure are intended to distinguish between similar objects, but are not necessarily intended to describe a particular sequence or a sequential order.

Recently, with development of artificial intelligence, in many scenarios, text needs to be converted into speech. Demand of people for converting text into speech is increasing. However, converting of text into speech relies on a speech synthesis technology. According to an existing speech synthesis technology, an acoustic model and a vocoder need to be trained in the process of converting text into speech. Losses may occur in the process of training the acoustic model. As a result, training accuracy of the acoustic model is not ideal, resulting in poor voice quality of synthesized speech.

Figure 1:
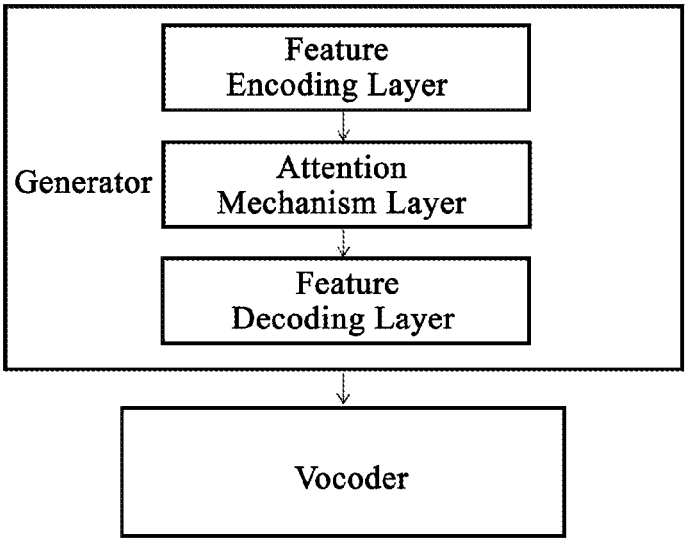
FIG. 1 is a schematic diagram of a structure of a GAN-based speech synthesis model according to an embodiment of the present disclosure.

To resolve a problem that training accuracy of the acoustic model is not ideal due to losses which may occur in the process of training the acoustic model, resulting in poor voice quality of the synthesized speech, according to a first aspect, referring to FIG. 1, the present disclosure provides a GAN-based speech synthesis model, including a generator and a vocoder.

The generator includes:

a feature encoding layer, configured to obtain a text feature based on a text vector, the text vector being obtained by processing to-be-converted text;

an attention mechanism layer, configured to calculate, based on a sequence order of the text feature, relevance between the text feature at a current position and an audio feature within a preset range, and determine contribution values of each text feature relative to different audio features within the preset range, the audio feature being used for indicating an audio feature corresponding to a pronunciation object preset by the generator; and a feature decoding layer, configured to match the audio feature corresponding to the text feature based on the contribution value, and output a through the audio feature.

The generator is obtained by being trained based on a first discrimination loss for indicating a discrimination loss of the generator and a second discrimination loss for indicating a mean square error between the generator and a preset discriminator.

The vocoder is configured to synthesize target audio corresponding to the to-be-converted text from the target Mel-frequency spectrum.

In this embodiment, the generator of the speech synthesis model in the module functions to generate the target Mel-frequency spectrum based on the text vector obtained by processing the to-be-converted text. The feature encoding layer in the generator is configured to obtain the text feature based on the text vector. The text feature includes a part-of-speech feature, a characteristic of a current term, a prefix, a suffix, and the like. For example, the part-of-speech feature includes a noun, an article, a verb, or an adjective. The characteristic of a current term includes a number of words contained in the current term, whether other characters are contained, or the like. The prefix and the suffix are usually used in English or alphabetic text, and can also be obtained in Chinese characters.

The attention mechanism layer may calculate the relevance between the text feature and the audio feature based on the obtained text feature, and determine the contribution value between the text feature and the audio feature.

The feature decoding layer may match the audio feature corresponding to the text feature based on the contribution value between the text feature and the audio feature, and output the audio feature as the target Mel-frequency spectrum. The target Mel-frequency spectrum contains all audio features of the to-be-converted text. Finally, the vocoder analyzes the target Mel-frequency spectrum in a frequency domain based on a waveform in the target Mel-frequency spectrum; distinguishes between a unvoiced sound, a voiced sound, a vowel, a consonant, and the like; and synthesizes the target audio in conjunction with the waveform in the target Mel-frequency spectrum. By analyzing the Mel-frequency spectrum and in conjunction with the waveform in the target Mel-frequency spectrum, accuracy of the synthesized target Mel-frequency spectrum is improved, and acoustic losses occurring during the synthesis are reduced.

It should be noted that a feature encoding layer includes a convolutional filtering unit including a series of one-dimensional convolutional filterbanks, a highway network unit including a plurality of highway layers, and a bidirectional recurrent network unit including two GRU networks for bidirectional calculation. In the feature encoding layer, the convolutional filtering unit is configured to perform convolutional filtering on the text vector. During the convolutional filtering, an output of the convolutional filtering unit is stacked by outputs of a plurality of convolutional filterbanks, and an output of each time step is pooled along a time sequence, to ensure that current information invariance is increased during the calculation process.

The highway network unit is configured to further extract a higher-level feature from a text sequence. The bidirectional recurrent network unit is configured to perform bidirectional recurrent calculation on an output of the highway network unit, so as to further extract a contextual feature based on the feature extracted by the highway network unit, and form the final text feature for output.

The feature encoding layer can adopt an autoregressive structure, and includes an information bottleneck unit and a long and short-term memory network unit. The information bottleneck unit includes two fully connected layers, and is configured to perform bottleneck processing on the text feature. An output of the information bottleneck unit is spliced with an output (i.e., the contribution value) of the attention mechanism layer, and the spliced output is sent to the long and short-term memory network unit.

The long and short-term memory network unit includes a plurality of memory subunits. Generally, 1024 memory cell subunits are included. Each memory subunit is further composed of four components: a cell state, an input gate, an output gate, and a forget gate. The long and short-term memory network unit is configured to predict the target Mel-frequency spectrum more accurately in conjunction with contextual information based on the output of the information bottleneck layer. An output of the long and short-term memory network unit is further spliced with the output (i.e., the contribution value) of the attention mechanism layer. Linear projection processing is performed on the spliced output to obtain the target Mel-frequency spectrum.

In some embodiments, the vocoder can be any one of a channel vocoder, a formant vocoder, a pattern vocoder, a linear prediction vocoder, a relevance vocoder, and an orthogonal function vocoder.

Figure 2:
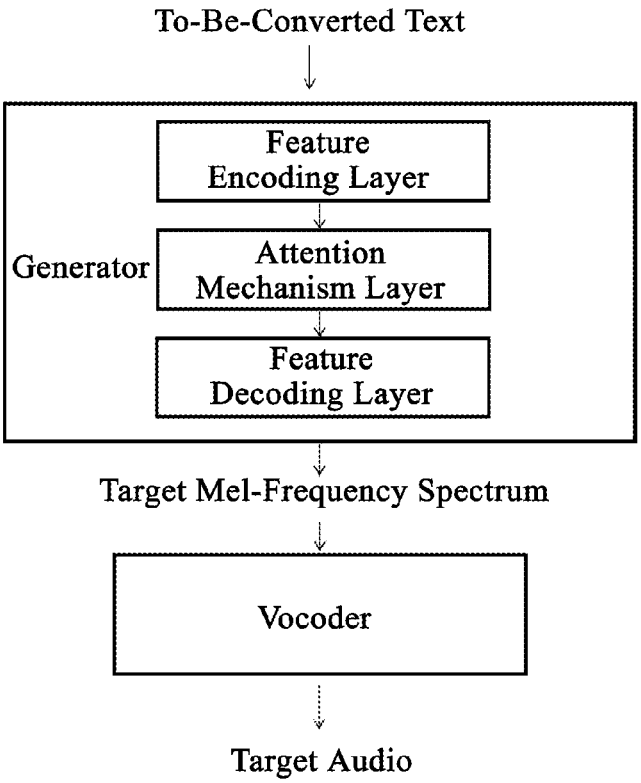
FIG. 2 is a schematic diagram of an operation flow of a GAN-based speech synthesis model according to an embodiment of the present disclosure.

As shown in FIG. 2, an operation flow of the speech synthesis model is: The text vector is input into the speech synthesis model. The generator in the speech synthesis model processes the text vector to obtain the target Mel-frequency spectrum. Further, the vocoder synthesizes the target audio corresponding to the to-be-converted text from the target Mel-frequency spectrum.

In some embodiments, the generator adopts a self-cycle structure or a non-self-cycle structure.

When adopting the self-cycle structure, the generator needs to output, strictly by the sequence order of text feature, the audio feature frame by frame as the target Mel-frequency spectrum. An output of a previous frame of the target Mel-frequency spectrum is an input of a next frame.

When adopting the non-self-cycle structure, the generator can output the target Mel-frequency spectrum in parallel based on the audio feature. Frames of the Mel-frequency spectrum are output simultaneously.

In this embodiment, the generator can select an appropriate output structure based on a text type. For text that does not require order preservation, a generator with a non-self-cycle structure may be used. For text that requires order preservation, a generator with a self-cycle structure may be used. In this way, for different text types, corresponding synthesis efficiency is improved and time costs are reduced.

Figure 3:
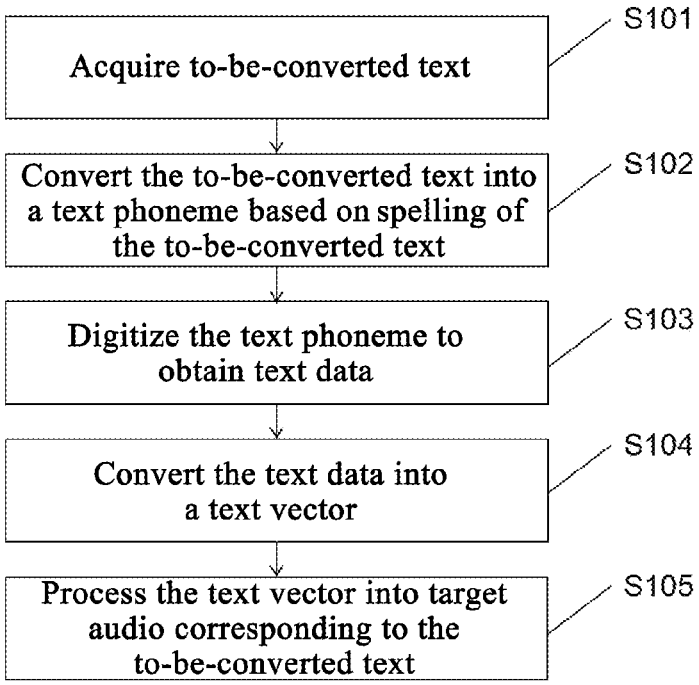
FIG. 3 is a flowchart of a speech synthesis method implemented by a speech synthesis model according to an embodiment of the present disclosure.

In some embodiments, referring to FIG. 3, for implementing a speech synthesis method, the model is configured to:

S101. Acquire to-be-converted text.

The to-be-converted text is text to be converted into text audio.

In some embodiments, the to-be-converted text can include a Chinese character, a short sentence, a complete sentence, or a paragraph composed of a plurality of complete sentences.

In some embodiments, the to-be-converted text can include a sentence or a term in one of a plurality of languages such as Chinese, English, Japanese, and French; or can include a sentence or a term in combination of two or more of the plurality of languages described above. For example, the to-be-converted text may be "我是中国人" ("I am Chinese."), "你好，我来，白中国，请多关照。" ("Hello, I come from China, I would appreciate any of your favour."), "Hello, 好久不见。" ("Hello, it's been a long time."), or the like. In this embodiment, the to-be-converted text is not only in one language, but can also be a mixture of a plurality of languages. The languages of the to-be-converted text are diverse, and can be applied to a wide range and variety of to-be-converted text.

S102. Convert the to-be-converted text into a text phoneme based on spelling of the to-be-converted text.

The to-be-converted text cannot be directly brought into the speech synthesis model provided in the present disclosure for synthesis of the target audio. Therefore, the to-be-converted text needs to be processed and be converted into the text phoneme, and then the text phoneme is brought into the speech synthesis model for synthesis.

Further, in some embodiments, when the model converts the to-be-converted text into the text phoneme based on the spelling of the to-be-converted text, step S102 can be evolved into:

S1021. Perform prosody prediction on the to-be-converted text to obtain encoded text.

The encoded text is obtained by segmenting content of the to-be-converted text according to content of a text sentence based on the pauses, pitch, sound intensity, and the like when people reads the to-be-converted text.

For example, if the to-be-converted text is "我是中国人。", after prosody prediction is performed on the to-be-converted text, "我#1 是#2 中国人。" is obtained. In this example, the to-be-converted text is segmented by using "#". In other embodiments, the to-be-converted text can be segmented by any text symbol that differs from a numeral or a letter, such as one of symbols "@", "*", "¥", and "&".

In this embodiment, after prosody prediction is performed, the output target audio may be closer to emotions of a real person who is speaking in terms of speech emotion, that is, for speaking, there may be a cadence of intonation, rather than that the content of the to-be-converted text is read mechanically.

In some embodiments, the prosody prediction further includes prediction of numerals and prediction of polyphonic characters. For example, a numeral "123" can be read in more than one way, such as "one hundred and twenty-three" or "one, two, three". In this case, pronunciation of the numeral "123" needs to be determined based on the to-be-converted text in conjunction with context of the numeral "123". The to-be-converted text is continued to be processed according to this pronunciation. A concept for the polyphonic character is the same as the foregoing manner. One Chinese character may have two or more pronunciations, and the pronunciation of the polyphonic character may be determined according to context. Details of description are not repeated herein.

In this embodiment, incorrect conversion due to a numeral or a polyphonic character in the to-be-converted text would not occur to the output target audio, thereby improving correctness of the conversion for the to-be-converted text.

S1022. Convert the encoded text into a spelling code. For example, for the to-be-converted text in Chinese, the spelling code includes pinyin and a tone numeral of the encoded text. For example, text is encoded as "我#1 是#2 中国人。". After the text is converted into to a spelling code, "wo3 #1 shi4 #2 zhong1 guo2 ren2" is obtained. The code following the pinyin is the tone numeral, which represents a pinyin tone of a single Chinese character in the sentence.

S1023. Convert the spelling code into the text phoneme based on pronunciation of the encoded text. If the spelling code is "wo3 #1 shi4 #2 zhong1 guo2 ren2.", after the spelling code is converted into the text phoneme based on the pronunciation of the pinyin to obtain "uuuo3 #1 shix4 #2 zhong1 guo2 ren2 @".

In addition, for the to-be-converted text in English, for example, an English text "I'm Chinese.", first, the English text may be regularized into "I am Chinese.", then prosody prediction may be performed to obtain encoded text, and finally phoneme conversion may be performed according to the prior phoneme conversion dictionary to obtain text phoneme "/AY7/AE7M/#1/CHAY6NIY7Z/@".

The above numeral 1 represents prosody, or intonation, such as, accent and non-accent. Typically, the numerals 0, 1 and 2 indicate non-accent, accent, and secondary accent, respectively.

S103. Digitize the text phoneme to obtain text data. In some embodiments, digitizing the text phoneme to obtain the text data includes:

digitizing the text phoneme based on a character code. The character code includes characters corresponding to a letter and a numeral in the text phoneme. For example, "uuuo3 #1 shix4 #2 zhong1 guo2 ren2 @" is digitized based on the character code. In the character code, numerals corresponding to characters are u=1, o=2, s=3, h=4, i=5, x=6, z=7, n=8, g=9, r=10, and e=11. After processing, "1112 3 #1 34564 #2 74289 1 912 2 10118 2" is obtained. It should be noted that the foregoing character code is merely for illustrative purposes and are not intended to be limited thereto, provided that byte encodes that facilitate distinguishing between different pinyin letters can be formulated according to actual situations.

In some embodiments, before converting the encoded text into the spelling code, the model is further configured to:

insert a pause character, at a position of a pause punctuation mark, into the encoded text, the pause character being used for segmenting the to-be-converted text based on the pause punctuation mark of the to-be-converted text;

insert an end character, at a position of an end punctuation mark, into the encoded text, the end character being used for determining an end position of the to-be-converted text based on the end punctuation mark of the to-be-converted text; and when converting the encoded text into the spelling code, converting the encoded text by segments based on the pause character and the end character.

In this embodiment, when the to-be-converted text is a long-text sentence, typically a plurality of punctuation marks are inserted in the long-text sentence. Different punctuation marks have different functions on the sentence. For example, punctuation marks such as ",", ";", and ":" indicate pauses of a sentence; punctuation marks such as ".", "!", and "?" indicate end of a sentence. Before the encoded text is converted into the spelling code, a corresponding character is inserted based on the punctuation mark in the to-be-converted text. For the punctuation mark indicating a pause, the pause character is inserted, and for the punctuation mark indicating an end, the end character is inserted. The encoded text is segmented based on different characters. During the process of converting the encoded text into the spelling code, conversion can be performed by using the pause character as a node, and conversion can also be performed by using the end character as a node. In this embodiment, the encoded text upon the conversion is segmented based on the punctuation mark, that is, the corresponding character, in the to-be-converted text. After the target audio is synthesized, the target audio may pause for preset time based on the corresponding character, so as to be closer to a natural state of human speech, thereby improving comfort of a user when listening to the target audio.

S104. Convert the text data into a text vector. The text vector can be a matrix vector, including a row vector and a column vector. The text vector can also be a numeric vector or the like. Converting the text data into the text vector facilitates extracting of the text feature in the text data by the speech synthesis model. Moreover, the contribution value of the text feature to the audio feature within the preset range is calculated. The audio feature corresponding to the text feature is matched based on the contribution value, so as to output the target Mel-frequency spectrum.

S105. Process the text vector into target audio corresponding to the to-be-converted text.

In this embodiment, the text vector is input into the speech synthesis model provided in the present disclosure to be processed by the feature encoding layer, the attention mechanism layer, and the feature encoding layer in the generator and output the target Mel-frequency spectrum. After the target Mel-frequency spectrum is obtained, the vocoder synthesizes the target audio based on the target Mel-frequency spectrum.

According to a second aspect, the present disclosure provides a GAN-based speech synthesis method, applicable to the GAN-based speech synthesis model described above. The method includes the following steps.

S201. Acquire to-be-converted text.

S202. Convert the to-be-converted text into a text phoneme based on spelling of the to-be-converted text.

S203. Digitize the text phoneme to obtain text data.

S204. Convert the text data into a text vector.

Steps S201 to S204 are the same as those for implementing the speech synthesis method by the foregoing speech synthesis model, but an execution body is not the foregoing speech synthesis model. Steps S201 to S204 can be performed by a computer, software, or the like, such as a system that can process to-be-converted text into a text vector.

S205. Input the text vector into the speech synthesis model to obtain target audio corresponding to the to-be-converted text.

In this embodiment, the text vector is obtained by processing to-be-converted text. The to-be-converted text is input directly into the speech synthesis model, and the speech synthesis model processes the text vector by a generator and a vocoder to output the target audio corresponding to the to-be-converted text.

Figure 4:
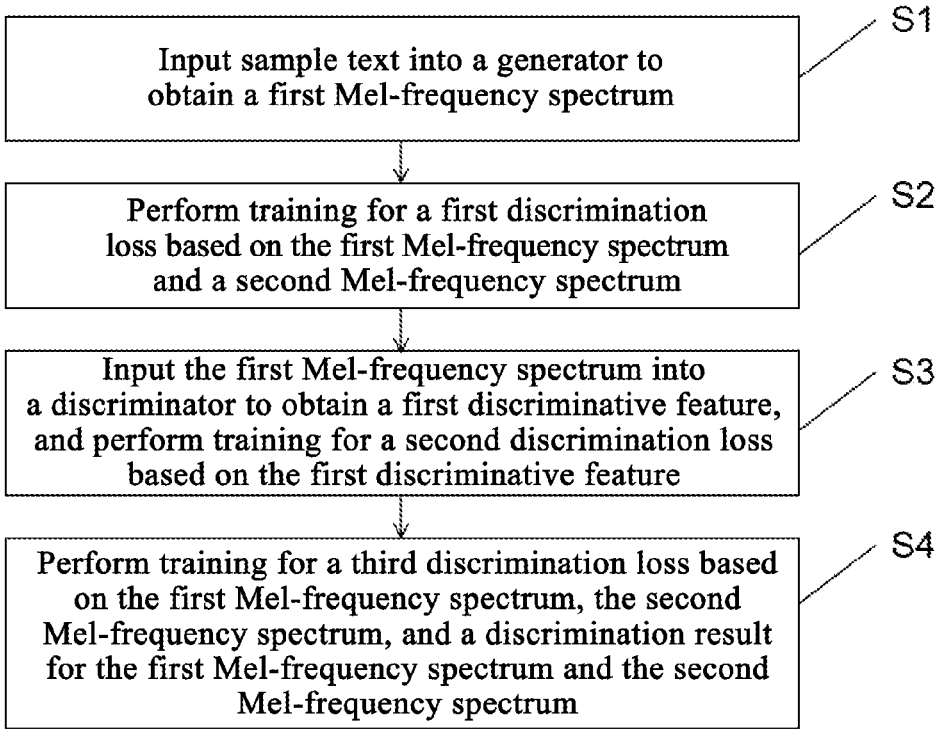
FIG. 4 is a flowchart of a training method for a GAN-based speech synthesis model according to an embodiment of the present disclosure.

According to a third aspect, the present disclosure provides a training method for a GAN-based speech synthesis model. Referring to FIG. 4, the method includes the following steps.

S1. Input sample text into a generator to obtain a first Mel-frequency spectrum.

The sample text is text used for training of the generator. To better train the generator, usually a large number of sample text needs to be prepared to train the generator. The first Mel-frequency spectrum is a Mel-frequency spectrum obtained by inputting a sample text into an untrained generator. Because the untrained generator can result in significant losses occurring during training, there are also great losses occurring in the first Mel-frequency spectrum.

S2. Perform training for a first discrimination loss based on the first Mel-frequency spectrum and a second Mel-frequency spectrum, the second Mel-frequency spectrum being a Mel-frequency spectrum for indicating an audio label of a corresponding annotation of the sample text.

The first discrimination loss is used for representing a spectrum loss occurring during the training of the generator. A large amount of spectrum losses may occur during the process of constantly generating the first Mel-frequency spectrum by the untrained generator. Nevertheless, as more sample text is input, the spectrum loss gradually decreases with increasing of times of training, until convergence occurs.

S3. Input the first Mel-frequency spectrum into a discriminator to obtain a first discriminative feature, and perform training for a second discrimination loss based on the first discriminative feature.

The second discrimination loss is used for determining the spectrum loss of the first Mel-frequency spectrum by using the second Mel-frequency spectrum as a reference spectrum. When a difference between the spectrum loss of the first Mel-frequency spectrum generated by the generator and a spectrum loss of the second Mel-frequency spectrum is too large, it indicates that loss accuracy of the first Mel-frequency spectrum is relatively low. In this case, the first discriminative feature determines that the first Mel-frequency spectrum does not meet an accuracy standard for output, and the training for the second discrimination loss continues to be performed. When the difference between the spectrum loss of the first Mel-frequency spectrum and the spectrum loss of the second Mel-frequency spectrum is smaller or is 0, it indicates that accuracy of the first Mel-frequency spectrum reaches that of the second Mel-frequency spectrum.

In some embodiments, the discriminator includes:

a training module, configured to perform training for the second discrimination loss based on the discriminative feature, and train third discrimination loss based on the first Mel-frequency spectrum, the second Mel-frequency spectrum, and a discrimination result.

S4. Perform training for a third discrimination loss based on the first Mel-frequency spectrum, the second Mel-frequency spectrum, and the discrimination result for the first Mel-frequency spectrum and the second Mel-frequency spectrum, the third discrimination loss being used for indicating a discrimination loss of the discriminator, and the discrimination result being used for indicating relevance between the first Mel-frequency spectrum and the second Mel-frequency spectrum.

In this embodiment, the discriminator may discriminate the first Mel-frequency spectrum and the second Mel-frequency spectrum, and output a discrimination result. When the difference between the spectrum loss of the first Mel-frequency spectrum and the spectrum loss of the second Mel-frequency spectrum is greater than a preset value, the discrimination result output from the discriminator is "false", indicating that the relevance between the first Mel-frequency spectrum and the second Mel-frequency spectrum is relatively small.

When the difference between the spectrum loss of the first Mel-frequency spectrum and the spectrum loss of the second Mel-frequency spectrum is less than a preset value, the discrimination result output from the discriminator is "true", indicating that the relevance between the first Mel-frequency spectrum and the second Mel-frequency spectrum is relatively large. When the accuracy of the first Mel-frequency spectrum reaches that of the second Mel-frequency spectrum, the first Mel-frequency spectrum generated by the generator is a target Mel-frequency spectrum.

It should be noted that the foregoing discrimination result being "true" or "false" is only exemplary description of this embodiment. In actual training, the discriminator can use any two different identifiers or discrimination results to represent whether the result is "true" or "false".

In some embodiments, the discriminator further includes:

a discrimination module, configured to obtain the discrimination result for the first Mel-frequency spectrum and the second Mel-frequency spectrum based on the relevance between the first Mel-frequency spectrum and the second Mel-frequency spectrum.

S2 to S4 are performed alternately until the first discrimination loss, the second discrimination loss, and the third discrimination loss converge, to obtain the trained generator.

In this embodiment, when the discrimination result output from the discriminator is "true", that is, the first discrimination loss, the second discrimination loss, and the third discrimination loss converge, the training of the generator is completed, and the trained generator is obtained.

During the training process, to gradually improve the accuracy of the first Mel-frequency spectrum, usually the training of the generator is performed once and then the training of the discriminator is performed once. After the discrimination result is obtained by the discriminator, the training of the generator is performed once more. The trainings of generator and the discriminator are performed alternately, until the first discrimination loss, the second discrimination loss, and the third discrimination loss converge. The discrimination result is true when the first discrimination loss, the second discrimination loss, and the third discrimination loss converge. In this case, the training of the generator is completed, and accuracy of a Mel-frequency spectrum synthesized by using the generator reaches that of the second Mel-frequency spectrum.

In this embodiment, acoustic losses occurring during speech synthesis by the generator are gradually reduced through constant adversary and trainings of the generator and the discriminator. During the adversary, the trainings of the generator and the discriminator are performed alternately, to improve accuracy of each other. Audio accuracy of speech synthesized by the generator obtained by using this method is higher, without great acoustic losses.

In some embodiments, the method further includes:

when a relevance between the first Mel-frequency spectrum and the second Mel-frequency spectrum is greater than a preset value, stopping the training for the first discrimination loss, the second discrimination loss, and the third discrimination loss, to obtain the trained generator.

In this embodiment, when the relevance between the first Mel-frequency spectrum and the second Mel-frequency spectrum is less than the preset value, it indicates that the discriminator can still distinguish between the first Mel-frequency spectrum generated by the generator and the second Mel-frequency spectrum. In this case, the training accuracy of the generator is insufficient, and the training of the generator needs to be performed once more. When the relevance between the first Mel-frequency spectrum and the second Mel-frequency spectrum is greater than the preset value, it indicates that the discriminator cannot distinguish between the first Mel-frequency spectrum generated by the generator and the second Mel-frequency spectrum. In this case, the accuracy of the first Mel-frequency spectrum reaches accuracy for output, and the trainings of the generator and the discriminator are stopped.

In some embodiments, a step of obtaining the third discrimination loss includes:

inputting the second Mel-frequency spectrum into the discriminator to obtain a second discriminative feature; and calculating a first mean square error between the first discriminative feature and 1 and a second mean square error between the second discriminative feature and 0, to obtain a first mean square error result and a second mean square error result.

In this embodiment, the third discrimination loss is composed of two parts of losses. The first part is obtained by inputting the first Mel-frequency spectrum into the discriminator to obtain the first discriminative feature, and calculating the first mean square error for the first discriminative feature and 1 to obtain the first mean square error result, that is, to obtain the first part of losses. The second part is obtained by inputting the second Mel-frequency spectrum into the discriminator to obtain the second discriminative feature, and calculating the second mean square error for the second discriminative feature and 0 to obtain the second mean square error result, that is, to obtain the second part of losses.

It can be learned from the foregoing solutions that, according to the first aspect, the present disclosure provides a GAN-based speech synthesis method. According to the speech synthesis method, the to-be-converted text is obtained and is converted into the text phoneme, the text phoneme is further digitized to obtain the text data, and the text data is converted into the text vector to be input into the speech synthesis model. In this way, the target audio corresponding to the to-be-converted text is obtained. According to the second aspect, the present disclosure provides a training method for a GAN-based speech synthesis model. According to the training method for a speech synthesis model, the sample text is input into the generator, the generator generates the first Mel-frequency spectrum, and the first Mel-frequency spectrum and the second Mel-frequency spectrum are input into the discriminator that is configured to discriminate the accuracy of the first Mel-frequency spectrum. During the discrimination process, the first discrimination loss, the second discrimination loss, and the trainings for the third discrimination loss of the generator and the discriminator are constantly performed to converge, to obtain the trained generator. According to the third aspect, the present disclosure provides a GAN-based speech synthesis model, including the generator and the discriminator. The generator processes the to-be-converted text into the target Mel-frequency spectrum, and then the vocoder converts the target Mel-frequency spectrum into target audio corresponding to the to-be-converted text. In the present disclosure, when the target Mel-frequency spectrum is generated by using the trained generator, the accuracy of the generated target Mel-frequency spectrum can reach that of the standard Mel-frequency spectrum. Through constant adversary between the generator and the discriminator and trainings thereof, acoustic losses of the target Mel-frequency spectrum are reduced, and acoustic losses of the target audio generated based on the target Mel-frequency spectrum are also reduced, thereby improving accuracy of audio synthesized from speech.

The terms "a plurality of embodiments", "some embodiments", "one embodiment", or "embodiment" mentioned throughout this specification mean that a component or a feature described in conjunction with the embodiments is included in at least one embodiment. Therefore, the phrases such as "in a plurality of embodiments", "in some embodiments", "in at least one another embodiment", or "in an embodiment" that appear throughout this specification may not necessarily refer to same embodiments. In addition, in one or more embodiments, specific features, structures, or features can be combined in any suitable manner. Therefore, without limitation, specific features, structures, or features illustrated or described in conjunction with one embodiment can be entirely or partially combined with features, structures, or features of one or more other embodiments. Such modification and variation are intended to fall within the scope of the present application.

Merely preferred implementations of the present disclosure are described above. It should be noted that for persons of ordinary skills in the art, improvements and modifications can be made without departing from the principles of the present application, and these improvements and modifications should also be considered as being subject to the protection scope of the present application.

What is claimed is:

1. A GAN-based speech synthesis model, comprising a generator, configured to be obtained by being trained based on a first discrimination loss for indicating a discrimination loss of the generator and a second discrimination loss for indicating a mean square error between the generator and a preset discriminator; and a vocoder, configured to synthesize target audio corresponding to to-be-converted text from a target Mel-frequency spectrum, wherein the generator comprises:

a feature encoding layer, configured to obtain a text feature based on a text vector, the text vector being obtained by processing the to-be-converted text;

an attention mechanism layer, configured to calculate, based on a sequence order of the text feature, a relevance between the text feature at a current position and an audio feature within a preset range, and determine contribution values of each text feature relative to different audio features within the preset range, the audio feature being used for indicating an audio feature corresponding to a pronunciation object preset by the generator; and a feature decoding layer, configured to match the audio feature corresponding to the text feature based on the contribution value, and output the target Mel-frequency spectrum by the audio feature.

2. The GAN-based speech synthesis model according to claim 1, wherein the generator adopts a self-cycle structure or a non-self-cycle structure.

3. The GAN-based speech synthesis model according to claim 1, wherein for implementing a speech synthesis method, the model is configured to:

acquire the to-be-converted text;

convert the to-be-converted text into a text phoneme based on spelling of the to-be-converted text;

digitize the text phoneme to obtain text data;

convert the text data into a text vector; and process the text vector into the target audio corresponding to the to-be-converted text.

4. The GAN-based speech synthesis model according to claim 3, wherein for converting the to-be-converted text into the text phoneme based on the spelling of the to-be-converted text, the model is configured to:

perform prosody prediction on the to-be-converted text to obtain encoded text;

convert the encoded text into a spelling code comprising pinyin and a tone numeral of the encoded text; and convert the spelling code into the text phoneme based on pronunciation of the encoded text.

5. The GAN-based speech synthesis model according to claim 4, wherein for digitizing the text phoneme to obtain the text data, the model is configured to:

digitize the text phoneme based on a character code, the character code including characters corresponding to a pinyin letter and a tone numeral in the text phoneme.

6. The GAN-based speech synthesis model according to claim 5, wherein the model is further configured to: before converting the encoded text into the spelling code, insert a pause character, at a position of a pause punctuation mark, into the encoded text, the pause character being used for segmenting the to-be-converted text based on the pause punctuation mark of the to-be-converted text;

insert an end character, at a position of an end punctuation mark, into the encoded text, the end character being used for determining an end position of the to-be-converted text based on the end punctuation mark of the to-be-converted text; and convert the encoded text by segments based on the pause character and the end character for the converting of the encoded text into the spelling code.

7. A GAN-based speech synthesis method, applicable to the speech synthesis model according to claim 1, comprising:

acquiring to-be-converted text;

converting the to-be-converted text into a text phoneme based on spelling of the to-be-converted text;

digitizing the text phoneme to obtain text data;

converting the text data into a text vector; and inputting the text vector into the speech synthesis model to obtain target audio corresponding to the to-be-converted text.

* * * * *